US005167123A

United States Patent [19]

Brandon

[11] Patent Number: 5,167,123

[45] Date of Patent: Dec. 1, 1992

[54] FLOW CONDENSING DIFFUSERS FOR SATURATED VAPOR APPLICATIONS

[76] Inventor: Ronald E. Brandon, 1734 Lenox Rd., Schenectady, N.Y. 12308

[21] Appl. No.: 819,879

[22] Filed: Jan. 13, 1992

[51] Int. Cl.[5] ..... F01D 25/30; F01B 31/16

[52] U.S. Cl. ..... 60/690; 60/694; 60/697; 62/116; 165/47

[58] Field of Search ..... 60/685, 690, 694, 697; 62/116; 165/47

[56] References Cited

U.S. PATENT DOCUMENTS 1,091,581 7/1914 Ljungstrom .
1,131,645 11/1915 Kerr .
1,269,998 4/1918 Baumann .
2,762,560 10/1956 Jakobsen .
2,810,545 7/1957 Buchi .
3,306,575 6/1967 Frankel .
3,338,052 5/1967 Holden .
3,498,062 4/1970 Daltry .
4,214,452 1/1980 Riollet et al. .
4,961,309 11/1990 Liebl .

*Primary Examiner*—Allen M. Ostrager
*Attorney, Agent, or Firm*—Ross, Ross & Flavin

[57] ABSTRACT

A method and apparatus is provided for improving the performance of vapor turbine diffusers by preventing flow separation from the diffuser walls. Such separation from the diffuser walls is decreased or eliminated herein by chilling the diffuser walls below the saturation temperature, causing some condensation to occur and insuring vapor flow toward the walls to eliminate the natural tendency toward separation in diffusing vapor passages.

6 Claims, 2 Drawing Sheets

FLOW CONDENSING DIFFUSERS FOR SATURATED VAPOR APPLICATIONS

BACKGROUND OF THE INVENTION

1. Field of the Invention

This invention applies to saturated vapor passages where high velocity conditions can be advantageously slowed by means of a flow diffuser that simultaneously causes the static pressure to rise as vapor velocity is decreased by increasing the flow area. An ideal diffuser would reversibly convert the high initial kinetic energy to potential energy, thus increasing the static pressure.

2. Description of the Prior Art

Diffusers, for example, are commonly employed in steam turbines. Effective diffusers can improve turbine efficiency and output. Unfortunately, the complicated flow patterns existing in such turbines as well as the design problems caused by space limiations make fully effective diffusers almost impossible to design. A frequent result is flow separation that fully or partially destroys the ability of the diffuser to raise the static pressure as the steam velocity is reduced by increasing the flow area. This is often caused by a vapor boundary layer that gets thicker along the diffuser surface in the direction of flow ultimately permitting the flow separation mentioned above.

In operation, the turbine shaft and last stage rotating blades rotate at high speed, often at 3600 rpm, with over 1800 feet per second top speed. Steam exhausts from the last stage buckets or rotating blades with axial velocity approaching sonic velocity and, in addition, a variable amount of residual whirl. Up to a limit, the lower the absolute static pressure at the discharge of the last stage rotating blade, the greater is the turbine available energy and the turbine output. The limit occurs when the axial steam velocity in the annular space immediately downstream from the last stage rotating blade equals sonic velocity. This is typically about 1220 feet per second for wet steam at the discharge of the low pressure turbine. Any further dropping of static pressure below this condition will not result in increased output and may in fact, slightly reduce output.

For most turbines, during most operating conditions, the exhaust static pressure is above the limit described above. As a result, a system that lowers the static pressure at the last stage exhaust will improve cycle efficiency and turbine output. This is the purpose of the diffusers that currently exist in most turbine section exhausts.

In the last stage example mentioned above, the condenser hotwell pressure is essentially established by the condenser tube geometry, the temperature of the circulating water, and the heat to be removed from the steam exhausted from the turbine.

The static pressure of the steam exiting the exhaust hood and entering the condenser is usually close to the pressure existing in the hotwell, depending on local flow interferences such as pipes and side wall obstructions and feed water heaters. It should be recognized that if there are significant interferences, the pressure at the discharge of the exhaust hood will be higher than the hotwell.

The static pressure at the discharge side of the diffuser will be higher than that of the exhaust hood discharge by the amount of pressure drop required to turn the flow from nearly axial to vertical and by the necessary pressure drop caused by passage of pipes, struts, and other such interferences.

It should be also noted that for downward exhaust hoods the loss from the diffuser discharge to the exhaust hood discharge varies from top to bottom. At the top, much of the flow must be turned 180° to place it over the diffuser and inner casing, then turned downward. Pressure at the top is thus higher than at the sides which are in turn higher than at the bottom.

The static pressure at the annulus immediately downstream of the last stage rotating blade will be lower than that at the discharge of the diffuser by the amount of successful diffusion, that is, the degree to which the reduced average velocity has been successfully turned into higher static pressure as the steam flows along the diffusing path.

This will be harmfully affected by the strong tendency of the high velocity flow to separate off either the diffuser at the outer periphery or the inner flow surface usually called the bearing cone.

In the most successful of existing downward exhaust hoods, the average static pressure at the discharge of the last stage is close to the static pressure at the hotwell. Most turbines are poorer than this. Reduction of diffuser and bearing cone flow separation would provide significant performance improvement.

There is a need for improved diffusers in both existing and new steam turbines. It is believed that many other fluid flow diffusers where the fluid is saturated vapor could also benefit from the present invention

SUMMARY OF THE INVENTION

The present invention comprises a system and means to cause the walls of a diffuser and bearing cone to be colder than the saturation temperature of the vapor being diffused. This results in portions of the boundary layer of the flow, which are in direct contact with the diffuser and bearing cone cold walls, to become condensed, preventing the boundary layer from becoming excessively thick as it flows along the diffuser and bearing cone surfaces, such thickening being one of the major causes of flow separation.

It is an object of the present invention to prevent or reduce flow separation in the diffuser, thus improving pressure recovery, efficiency and heat rate.

These and other objects and advantages of the present invention will become apparent with reference to the attached detailed description and related drawings.

DESCRIPTION OF THE PREFERRED EMBODIMENTS

Figure 1:
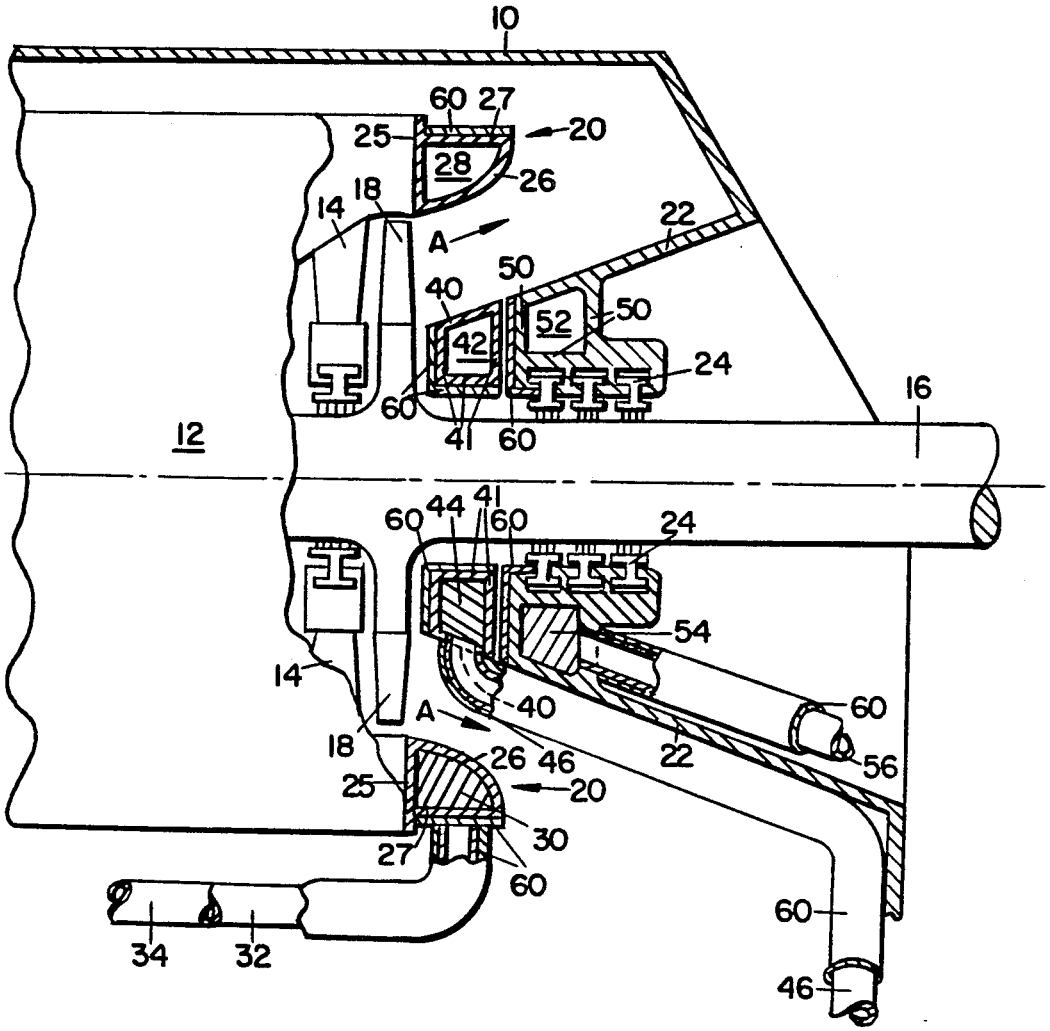
FIG. 1 is a fragmentary side elevational view of a low pressure turbine, party in cross section, and with parts broken away, illustrating the preferred arrangement of the invention.

FIG. 1 depicts a typical arrangement of a low pressure turbine of which only one end of a double flow unit is shown. An exhaust hood 10 surrounds an inner casing 12, which in turn, encloses and supports the stationary parts of the low pressure stages such as a last stage diaphragm 14. A turbine rotor 16 is turned by the force of high velocity steam which is directed against rotating blades 18 which are mounted in a full circle around the rotor. Only the last stage of the low pressure turbine is shown but it will be recognized that most low pressure turbines will include about six stages per end, although more and less would also be common.

A diffuser 20 is securely mounted on inner casing 12 adjacent the last stage rotating blade 18 A bearing cone 22 supports packing rings 24 that separate the vacuum condition that exists inside exhaust hood 10 from atmospheric pressure on the outside. Bearing cone 22, in combination with a surface 40 to be described, also provide the inner surface diffusing flow path of steam exiting the last stage bucket in the direction of the arrows A. After leaving the diffusing path the steam must be turned downward to enter a condenser, not shown, mounted directly on the bottom of the exhaust hood. A hotwell, also not shown, is at the bottom of the condenser. Additionally not shown are the bearings which support the shaft and which would often be mounted in the bearing cone 22.

Diffuser 20 includes walls 25, 26 and 27 which define an internal annular cooling passage or water circulating space 28 which persists for the full 360° of the diffuser except at the diffuser base where a divider or partition wall 30 extends across passage 28.

Cold water is delivered to circulating space 28 by an inlet pipe 32 and exits from space 28 as somewhat warmed water through an exit pipe 34 located adjacent pipe 32, (see FIG. 2), with divider or partition wall 30 precluding any mingling of the cold entry water with the warmed exit water.

Dual cooling means are provided for bearing cone 22 and include first and second cold water ducts 42 and 52 respectively, mounted within the bearing cone.

First cold water duct 42 includes walls 40 and 41 which define an internal annular cooling passage or water circulating space 42 which persists for the full 360° of the bearing cone except at the duct base where a divider or partition wall 44 extends across space 42.

Cold water is delivered to circulating space 42 by an inlet pipe 46 and exits from space 42 as somewhat warmed water through an exit pipe 48 located adjacent pipe 46, (see FIG. 2), with divider or partition wall 44 precluding any mingling of the cold entry water with the warmed exit water.

Second cold water duct 52 includes an outer wall of bearing cone 22 and inner walls 50 which define an internal annular cooling passage or water circulating space 52 which persists for the full 360° of the bearing cone except at the duct base where a divider or partition wall 54 extends across space 52.

Cold water is delivered to circulating space 52 by an inlet pipe 56 and exits from space 52 as somewhat warmed water through an exit pipe 58 located adjacent pipe 56, (see FIG. 2), with divider or partition wall 54 precluding any mingling of the cold entry water with the warmed exit water.

Within exhaust hood 10 in those areas where a cold surface is not needed, pipes and ducts are insulated from warmer fluids by such methods as metal lagging as shown in areas indicated by 60.

Figure 2:
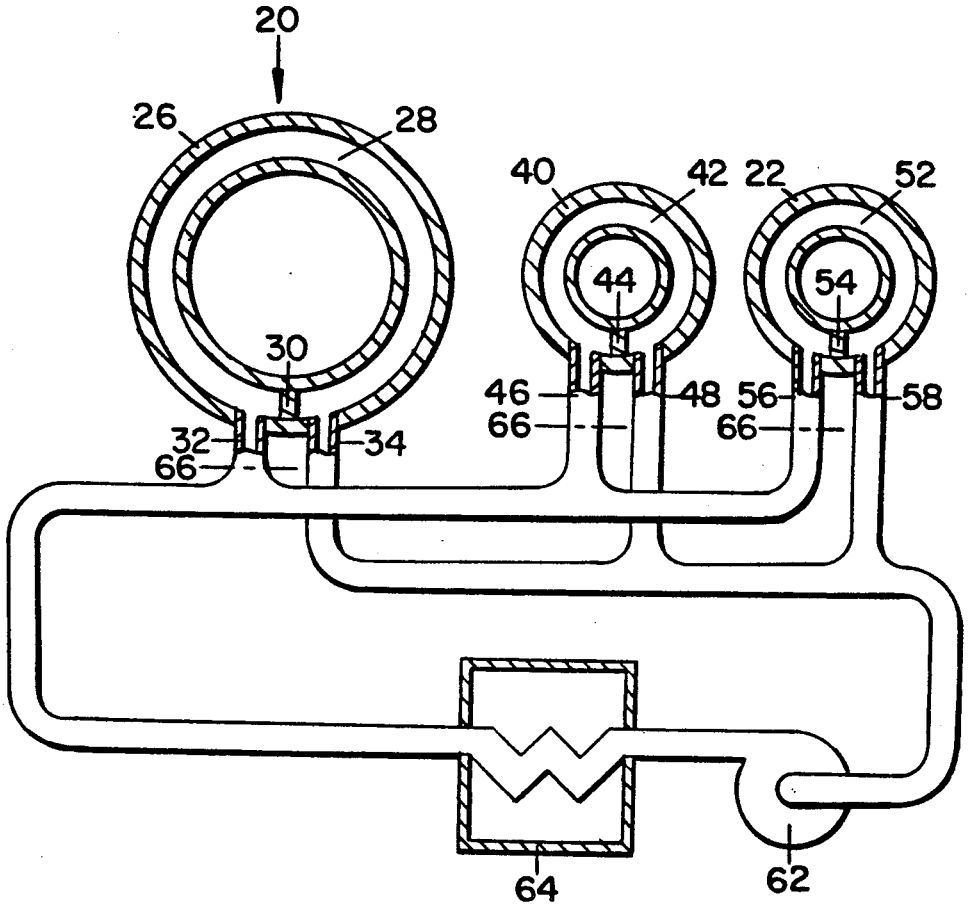
FIG. 2 is a schematic view of the preferred arrangement showing supporting equipment.

With reference to FIG. 2, support equipment includes a pump 62, which circulates cold water through the pipe and duct system and a water cooler or chiller 64 to cool the water.

Orifices 66 are used in each inlet pipe 32, 46 and 56 to insure the proper split and magnitude of cooling flow.

Not shown in the support system are necessary temperature and pressure sensors, shut off and control valves, storage tank, water make-up supply, air vent, pressure limiter and other normal accessories for a water cooling system.

The condensate flow could be the source of make up water for the cooling system.

In the preferred embodiment of the invention, cool water is circulated so as to cool wall surface 26 of diffuser 20, wall surface 40 of duct 42 and cone surface 22 of duct 52 in the flow path A of steam exiting the last stage bucket. The water should be of sufficient quantity to assure condensing a small amount of the steam passing in contact with those surfaces. Up to 1% of the steam could be considered a desirable amount. The amount of condensation should be enough to keep flow boundary layers thin. The cool water should flow in sufficient quantity to pick up approximately 10° to 20° in temperature and always be about 10° F. lower than the steam saturation temperature.

A variety of systems could be considered to obtain water about 20° F. cooler than the saturation temperature of exhausting steam. These could include the ordinary circulating water which sometimes may be about that temperature. Sometimes makeup water to the turbine feed-water system may be the proper temperature and amount. A special cooler may be needed to create the right temperature and flow rate. A heat pump could also be used with a variety of heat rejection media including ambient air, ground water or circulating water.

Non-water cooling is also possible using other fluids or refrigerants.

While a turbine example has been used to illustrate the invention, other vapor diffusers operating near the fluid saturation points could also employ the concept.

The condensation function of the cooled diffuser and duct surfaces can benefit from a wall that has a minimum resistance to heat flow. To that end the wall should be thin or of high conductivity. It is recognized that in the turbine example, the outer diffuser and duct walls will be exposed to high velocity water droplets that are known to erode materials such as carbon steel A harder or better protected surface will be required in such areas.

For diffusers employed on fluids that are not practically condensable in the boundary layer area the diffuser surface could be perforated or slotted so that suction applied to the hollow diffuser wall could continuously draw boundary layer flow away to accomplish the same effect provided by the condensation systems described earlier.

Separate cooling ducts 42 and 52 are employed in bearing cone 22 to facilitate assembly and disassembly of the turbine. In FIG. 1 it can be seen that when the upper half exhaust hood 10 is lifted vertically the bearing cone must not interfere with diffuser 20

To prevent such interference, duct 42 is made separate from duct 52 and is bolted to the lower half. When the upper half is lifted, duct 42 remains in place and the part of the bearing cone that rises is short enough to avoid contact with diffuser 20. The same effect could be accomplished by having a portion of diffuser 20 removable so that it would permit the entire bearing cone to be lifted vertically. In such a case, ducts 42 and 52 could be combined into one duct.

The combined axial length of the chilled surfaces provided by ducts 42 and 52 need only be long enough to insure that the steam flow is fully in contact with the bearing cone surface and that the increased wall static pressure caused by turning the flow is great enough to insure against flow separation.

In accordance with the foregoing, the improved system and apparatus of the invention affords an efficient and effective way of increasing diffuser effectiveness and turbine performance. Numerous modifications and adaptations of the invention will be apparent to those of skill in the art, and thus it is intended by the appended claims to cover all such modifications and adaptations which fall within the true spirit and scope of the present invention.

I claim:

1. A method of improving the performance of saturated vapor flow diffusers having a vapor flow interface comprising, lowering the temperature at the diffuser-vapor flow interface below the vapor saturation temperature so as to condense a small amount of the vapor making up a significant portion of the boundary layer of the vapor flow, thereby preventing a separation of the flow from the interface.

2. In a steam turbine with a flow diffuser interface for saturated or nearly saturated vapor flow, a method of improving the diffuser interface comprising, lowering the temperature at the diffuser-vapor flow interface below the vapor saturation temperature so as to condense a small amount of the vapor making up a significant portion of the vapor flow boundary layer, thereby preventing a separation of the flow from the diffuser interface.

3. In a steam turbine with a flow diffuser interface for saturated or nearly saturated vapor flow, apparatus for improving the diffuser interface comprising means for lowering the temperature at the diffuser-vapor flow interface below the vapor saturation temperature so as to condense a small amount of the vapor making up a significant portion of the vapor flow boundary layer, thereby preventing a separation of the flow from the diffuser interface.

4. In a steam turbine with a flow diffuser interface and a bearing cone interface for saturated or nearly saturated vapor flow, apparatus for improving the interfaces comprising, means for lowering the temperature at the vapor flow interfaces below the vapor saturation temperature so as to condense a small amount of the vapor making up a significant portion of the vapor flow boundary layer, thereby preventing a separation of the flow from the interfaces.

5. In a steam turbine according to claim 4, wherein the means for lowering the temperature at the vapor flow interfaces comprises, cooling water ducts at each interface.

6. In a steam turbine according to claim 4, wherein the means for lowering the temperature at the vapor flow interfaces comprises, cooling water ducts at each interface, a partition wall within each duct, a water inlet into and a water outlet from each duct on each side of the partition wall, a pump for circulating the water through the ducts, and a cooling means for cooling the water.

* * * * *